US005080686A

United States Patent [19]

Garrecht et al.

[11] Patent Number: 5,080,686

[45] Date of Patent: Jan. 14, 1992

[54] ALKYL OR ALKENYL SUCCINIC ACIDS AS CORROSION INHIBITORS FOR OXYGENATED FUELS

[75] Inventors: Robert J. Garrecht, St. Louis; J. Irvine Knepper, Manchester; George W. Dear, Florissant, all of Mo.

[73] Assignee: Petrolite Corporation, St. Louis, Mo.

[21] Appl. No.: 435,527

[22] Filed: Oct. 20, 1982

[51] Int. Cl.[5] ..... C10L 1/18

[52] U.S. Cl. ..... 44/351; 44/404

[58] Field of Search ..... 44/70, 56, 62, 53, 351, 44/404; 252/396

[56] References Cited

U.S. PATENT DOCUMENTS

| | | | |
|---|---|---|---|
| 2,334,158 | 11/1943 | von Fuchs et al. | 252/396 |
| 2,349,044 | 5/1944 | Jahn | 252/396 |
| 3,004,923 | 10/1961 | Jursich | 44/70 |
| 3,231,587 | 1/1966 | Rense | 252/396 |
| 3,447,918 | 6/1969 | Amick | 252/396 |
| 3,927,041 | 12/1975 | Cengel | 44/70 |
| 4,214,876 | 7/1980 | Garth et al. | 252/396 |
| 4,294,585 | 10/1981 | Sung | 44/56 |
| 4,305,730 | 12/1981 | Davis et al. | 252/396 |
| 4,326,987 | 4/1982 | Hendricks et al. | 252/396 |
| 4,375,360 | 3/1983 | Washeoheck et al. | 44/56 |
| 4,392,866 | 7/1983 | Sung et al. | 44/53 |
| 4,440,545 | 4/1984 | Weidig | 44/56 |

*Primary Examiner*—Prince F. Willis
*Assistant Examiner*—Jerry D. Johnson
*Attorney, Agent, or Firm*—Leon Zitver; Stanley M. Tarter

[57] ABSTRACT

This invention relates to a corrosion inhibited system comprising (1) an oxygenated fuel, and (2) an alkenyl or alkyl succinic acid or a polymer thereof.

8 Claims, No Drawings

ALKYL OR ALKENYL SUCCINIC ACIDS AS CORROSION INHIBITORS FOR OXYGENATED FUELS

This invention relates to the use of alkyl or alkenyl succinic acids to inhibit the corrosion of metals in oxygenated fuel systems.

Because of the energy crises, oxygenated fuels such as alcohol have been employed as fuels, either alone, or in combination with petroleum products. Non-limiting examples of oxygenated fuels include ethanol, methanol, tertiary butyl alcohol (TBA), methyl tertiary butyl ether (MTBE) or mixtures thereof, which are incorporated into the fuel as fuel extenders, octane boosters or both.

We have now discovered that alkyl or alkenyl succinic acids or polymers thereof are excellent corrosion inhibitors for oxygenated fuel systems.

Gasohol (and other oxygenated fuels) present at least one special problem. That is if water is mixed with gasohol a clear solution results up to about 0.5 to 0.7% (depends upon fuel temperature and aromatic content of the gasoline). When the critical amount of water is exceeded a phase separation occurs. The separate phase contains both water and ethanol. In addition to the obvious potential problem of poor operability should this aqueous phase enter the fuel systems of vehicles there is the concern that this water/ethanol phase is quite corrosive. The compositions of the present invention are useful in solving this problem.

Alkyl or alkenyl succinic acids are utilizable in this invention. The general structural formulae of these compounds are:

Anhydride

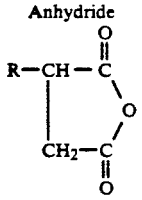

Acid

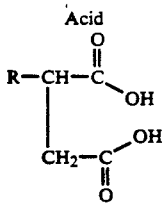

wherein R is an alkyl or alkenyl radical.

The alkenyl radical can be straight-chain or branched-chain; and it can be saturated at the point of unsaturation by the addition of a substance which adds to olefinic double bonds, such as hydrogen, sulfur, bromine, chlorine, or iodine. It is obvious, of course, that there must be at least two carbon atoms in the alkenyl radical, but there is no real upper limit to the number of carbon atoms therein. However, it is preferred to use an alkenyl succinic acid anhydride reactant having between about 8 and about 18 carbon atoms per alkenyl radical, e.g., 12 carbon atoms. Succinic acid anhydride and succinic acid are not utilizable herein.

Nevertheless, the alkenyl succinic acid anhydrides and the alkenyl succinic acids are interchangeable for the purposes of the present invention. Accordingly, when the term "alkenyl succinic acid acid" is used herein, it must be clearly understood that it embraces the alkenyl succinic acids as well as their anhydrides, the derivatives thereof in which the olefinic double bond has been saturated as set forth hereinbefore. Non-limiting examples of the alkenyl succinic acid anhydride reactant are ethenyl succinic acid anhydrides; ethenyl succinic acid; ethyl succinic acid anhydride; propenyl succinic acid anhydride; sulfurized prepenyl succinic acid anhydride; butenyl succinic acid, 2-methylbutenyl succinic acid anhydride; 1,2-dichloropentyl succinic acid anhydride; hexenyl succinic acid anhydride; hexyl succinic acid; sulfurized 3-methylpentenyl succinic acid anhydride; 2,3-dimethylbutenyl succinic acid anhydride; 3,3-dimethylbutenyl succinic acid; 1,2-dibromo-2-ethylbutyl succinic acid; heptenyl succinic acid anhydride; 1,2-dioctyl succinic acid; octenyl succinic acid anhydride; 2-methylheptenyl succinic acid anhydride; 4-ethylhexenyl succinic acid; 2-isopropylpentyl succinic acid anhydride; nonenyl succinic acid anhydride; 2-propylhexenyl succinic acid anhydride; decenyl succinic acid; decenyl succinic acid anhydride; 5-methyl-2-isopropylhexenyl succinic acid anhydride; 1,2-dibromo-2-ethyloctenyl succinic acid anhydride; decyl succinic acid anhydride; undecenyl succinic acid anhydride; 1,2-dichloro-undecyl succinic acid; 3-ethyl-2-t-butylpentenyl succinic acid anhydride; dodecenyl succinic acid anhydride; dodecenyl succinic acid; 2-propylnonenyl succinic acid anhydride; 3-butyloctenyl succinic acid anhydride; tridecenyl succinic acid anhydride; tetradecenyl succinic acid anhydride; hexadecenyl succinic acid anhydride; sulfurized octadecenyl succinic acid; octadecyl succinic acid anhydride; 1,2-dibromo-2-methylpentadecenyl succinic acid anhydride; 8-propylpentadecyl succinic acid anhydride; eicosenyl succinic acid anhydride; 1,2-dichloro-2-methylnona decenyl succinic acid anhydride; 2-octyldodecenyl succinic acid; 1,2-diiodotetracosenyl succinic acid anhydride; hexacosenyl succinic acid, hexacosenyl succinic acid anhydride; and hentriacontenyl succinic acid anhydride.

The methods of preparing the alkenyl succinic acid anhydrides are well known to those familiar with the art. The most feasible method is by the reaction of an olefin with maleic acid anhydride. Since relatively pure olefins are difficult to obtain, and when thus obtainable, are often too expensive for commercial use, alkenyl succinic acid anhydrides are usually prepared as mixtures by reacting mixtures of olefins with maleic acid anhydride. Such mixtures, as well as relating pure anhydrides, are utilizable herein.

Corresponding alkyl succinic anhydrides can also be employed, i.e., where the alkenyl group is saturated in any of the above instances; The preparation of alkyl succinic acids and anhydrides thereof is well known to the art.

In addition other alkenyl succinic acids can also be employed such as by way of illustration and not of limitation polymeric alkenyl succinic acids such as those containing the following repetitive unit

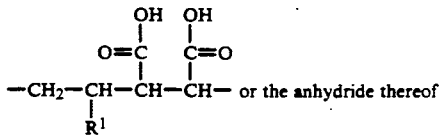

where R' is a hydrocarbon group having at least about 8 carbons such as about 8 to 48 carbons, for example from about 12 to 42 carbons, but preferably from about 20 to 28 carbons. Preferably the hydrocarbon group is alkyl.

The following examples are presented by way of illustration to prove the effectiveness of the present compositions in oxygenated fuels.

TABLE I

Additive Compositions Tested

Composition M

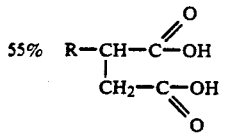

where R is

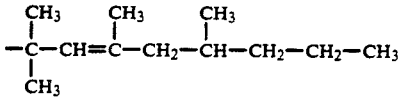

45% aromatic hydrocarbon solvent

Composition N

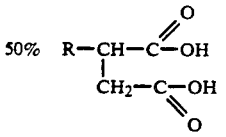

where R = $CH_3(CH_2)_{11}$—

50% aromatic hydrocarbon solvent

Composition P

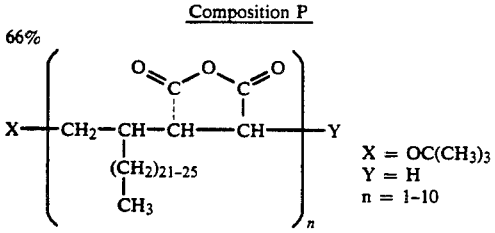

34% aromatic hydrocarbon solvent

Composition R

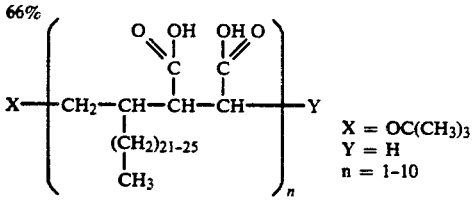

34% aromatic hydrocarbon solvent

TABLE II

Fuels Employed in Tests

| No. | Fuel |
|---|---|
| 1 | Unleaded Reference Gasoline |
| 1-A | 90% no. 1 + 10% Ethanol |
| 1-B | 95% no. 1 + 5% Oxinol ® |
| 2 | Canadian Reg. leaded gasoline |
| 2-A | 90% no. 2 + 10% Ethanol |
| 2-B | 95% no. 2 + 5% Oxinol ® |
| 3 | Canadian Premium no lead gasoline |
| 3-A | 90% no. 3 + 10% Ethanol |
| 3-B | 95% no. 3 + 5% Oxinol ® |
| 4 | Canadian reg. no lead gasoline |
| 4-A | 90% no. 4 + 10% Ethanol |
| 4-B | 95% no. 4 + 5% Oxinol ® |
| 5 | Gulf Coast no lead gasoline |

TABLE II-continued

Fuels Employed in Tests

| | |
|---|---|
| 5-A | 90% no. 5 + 10% Ethanol |
| 5-B | 95% no. 5 + 5% Oxinol ® |
| 6 | Major Unleaded gasoline |
| 6-A | 90% no. 6 + 10% Ethanol |
| 6-B | 95% no. 6 + 5% Oxinol ® |
| 7 | Major unleaded |
| 7-A | 90% no. 7 + 10% Ethanol |
| 7-B | 95% no. 7 + 5% Oxinol ® |

National Association of Corrosion Engineers
N.A.C.E. TM-01-72

Apparatus: As specified in ASTM method D-665.

Procedure:
1. Insert polished spindle into 300 ml of test fuel
2. Allow spindle 10 minute static and 20 minute dynamic wetting time at 100° F.
3. Add 30 ml of distilled $H_2O$ and stir for 3½ hrs.
4. Remove spindle, wash with isopropyl alcohol, then isooctane, air dry and grade immediately.

Rating Index:

| | |
|---|---|
| A | 100% rust free |
| B++ | 0.1% or less of total surface area rusted |
| B+ | 0.1%-5% total surface area rusted |
| B | 5%-25% total surface area rusted |
| C | 25%-50% total surface area rusted |
| D | 50%-75% total surface area rusted |
| E | 75%-100% total surface area rusted |

TABLE III

NACE Rust Test Results
Procedure: NACE TM-01-72

| Fuel No. | Additive Added | Conc. ppm (V/V) | Spindle Rating Letter | Spindle Rating % Rust |
|---|---|---|---|---|
| 1 | none | — | E | 80 |
| 1-A | none | — | E | 80 |
| 1-A | Composition M | 1.0 | B++ | (1 spot) |
| 1-B | none | — | D | 65 |
| 2 | Composition M | 1.0 | A | 0 |
| 2-A | Composition M | 1.0 | A | 0 |
| 2-B | Composition M | 1.0 | A | 0 |
| 3 | none | — | E | 80 |
| 3 | Composition M | 1.0 | A | 0 |
| 3-A | none | — | E | 90 |
| 3-A | Composition M | 1.0 | B++ | (2 spots) |
| 3-B | none | — | B+ | 2 |
| 3-B | Composition M | 1.0 | A | 0 |
| 4 | none | — | E | 90 |
| 4 | Composition M | 1.0 | B++ | (2 spots) |
| 4-A | none | — | E | 90 |
| 4-A | Composition M | 3.0 | B+ | (<1%) |
| 4-A | Composition M | 3.5 | A | 0 |
| 4-B | none | — | C | 25 |
| 4-B | Composition M | 1.0 | A | 0 |

TABLE IV

NACE Rust Test Results
Procedure: NACE TM-01-72

| Fuel No. | Additive Added | Conc. ppm (v/v) | Spindle Rating Letter | Spindle Rating % Rust |
|---|---|---|---|---|
| 5 | none | — | C | 40 |
| 5 | Composition M | 1.0 | A | 0 |
| 5A | none | — | E | 90 |
| 5A | Composition M | 1.0 | A | 0 |
| 5B | none | — | D | 60 |
| 5B | Composition M | 1.0 | A | 0 |
| 6 | none | — | E | 90 |
| 6 | Composition M | 1.0 | A | 0 |
| 6 | Composition M | 2.0 | A | 0 |
| 6 | Composition M | 3.0 | A | 0 |
| 6A | none | — | E | 90 |
| 6A | Composition M | 1.0 | B | 7 |
| 6A | Composition M | 2.0 | B+ | 2 |
| 6A | Composition M | 3.0 | B++ | (4 spots) |
| 6A | Composition M | 4.0 | A | 0 |
| 6B | none | — | C | 30 |
| 6B | Composition M | 1.0 | B+ | <1 |
| 6B | Composition M | 2.0 | A | 0 |

TABLE IV-continued

NACE Rust Test Results
Procedure: NACE TM-01-72

| Fuel No. | Additive Added | Conc. ppm (v/v) | Spindle Rating Letter | Spindle Rating % Rust |
|---|---|---|---|---|
| 6B | Composition M | 3.0 | A | 0 |
| 7 | none | — | D | 60 |
| 7 | Composition M | 1.0 | A | 0 |
| 7A | none | — | E | 90 |
| 7A | Composition M | 1.0 | B++ | (1 spot) |
| 7B | none | — | C | 25 |
| 7B | Composition M | 1.0 | A | |

TABLE V

NACE Rust Test Results
Procedure: NACE TM-01-72

| Fuel No. | Additive Added | Conc. (lb/Mbbl | Spindle Rating Letter | Spindle Rating % Rust |
|---|---|---|---|---|
| 1 | none | — | E | 90% |
| 1 | Composition N | 20 | A | 0 |
| 1 | Composition N | 8 | A | 0 |
| 1 | Composition N | 6 | A | 0 |
| 1 | Composition P | 10 | A | 0 |
| 1 | Composition P | 6 | A | 0 |
| 1 | Composition P | 4 | B++ | (1 spot) |
| 1 | Composition R | 10 | A | 0 |
| 1 | Composition R | 4 | B+ | <1% |
| 1A | Composition N | 8 | A | 0 |
| 1A | Composition P | 14 | A | 0 |

Gasohol Static Corrosion Test Procedure D

Objective

This test is used to determine the corrosive effects of a water/ethanol phase on various metals that are in direct contact with this mixture.

Summary

A polished metal coupon is totally immersed in a water/ethanol phase obtained by adding water to gasohol in an amount sufficient to extract ethanol into the aqueous phase. The sample is stored in the dark at room temperature. The coupon is visually inspected for evidence of corrosion and weight changes are also recorded.

Procedure

A one-inch square metal coupon with a ¼ inch centered hole is polished, rinsed in heptane then acetone, and dried. Initial coupon weight is then obtained. Two hundred (200) mls of gasohol are placed in an 8-ounce acid-cleaned jar. Twenty (20) mls of water are added to the gasohol and shaken thoroughly to effect the separation of a lower water/ethanol phase. The metal coupon is then suspended in the lower phase using a ¼ inch glass rod with an enlarged and flattened end so that the coupon surface is totally immersed in the lower phase but off the bottom of the jar. The jar lid is sealed and the jar is placed in a dark environment. Visual inspections for evidence of corrosion are made periodically and a coupon weight change is recorded at the end of the test. The corrosion products, if any, are removed using a camel's hair brush prior to obtaining a final weight.

Visual Rating System

| Rating | Coupon Appearance | |
|---|---|---|
| 0 | Corrosion free | — |
| 1 | very little corrosion | 1% surface area corroded |
| 2 | light corrosion | 1 to 10% surface area corroded |
| 3 | moderate corrosion | 10 to 25% surface area corroded |
| 4 | heavy corrosion | 25 to 50% surface area corroded |
| 5 | very heavy corrosion | 50 to 100% surface area corroded |

TABLE VI

Static Corrosion Test Results - Aqueous Phase - Zinc

Procedure: Gasohol Static Corrosion Test, Procedure D
Water: Deionized
Coupons: Zinc. Anode Grade, ASTM B-6, Type I, 99.90% Pure. 1 inch × 1 inch × 0.50 inch with ¼ inch centered hole. Initial polish with 280 grit paper by coupon supplier. Final polish with nylon pads (Norton #707 Bear-Tex).

| Additive | Conc. (ppm) | Fuel: 100% Unleaded Gasoline Visual Corrosion Rating 1 day | 2 days | Fuel: 90% Unleaded Gasoline: 10% Ethanol Visual Corrosion Rating 1 day | 2 days |
|---|---|---|---|---|---|
| none | 0 | 5 | 5 | — | — |
| none | 0 | — | — | 5 | 5 |
| Composition M | 3 | 0 | 0 | — | — |
| Composition M | 6 | — | — | 0 | 0 |
| Composition N | 3 | 0 | 0 | — | — |
| Composition N | 6 | — | — | 0 | 0 |
| Composition R | 3 | 2 | 4 | — | — |
| Composition R | 6 | — | — | 2 | 2 |

TABLE VII

Gasohol Static Corrosion Test Results - Aqueous Phase - Steel

Procedure: Gasohol Static Corrosion Test, Procedure D.
Fuel: 90% unleaded gasoline
10% Fuel Grade Ethanol
Water: deionized water
Coupons: Low carbon steel, C-1010, cold rolled, #4 temper. 1 inch × 1 inch × 0.03 inch with ¼ inch centered hole. Initial polish with 280 grit paper by coupon supplier. Final polish with nylon pads. (Norton #707 Bear-Tex).

Results:

| Additive | Con. (v/v ppm) | Visual Observations for Evidence of Corrosion 1 day | 2 days |
|---|---|---|---|
| No Add. | — | 5 | 5 |
| Composition M | 6.0 | 0 clean | 0 clean |

TABLE VIII

Gasohol Static Corrosion Test Results - Aqueous Phase - Steel

Procedure: Gasohol Static Corrosion Test, Procedure D.
Fuel: 100% unleaded gasoline
Water: deionized water
Coupons: Low carbon steel, C-1010, cold rolled, #4 temper, 1 inch × 1 inch × 0.03 inch with ¼inch centered hole. Initial polish with 280 grit paper by coupon supplier. Final polish with nylon pads (Norton #707 Bear-Tex).

TABLE VIII-continued

| Gasohol Static Corrosion Test Results - Aqueous Phase - Steel | | | |
|---|---|---|---|
| Results: | | | |
| | Conc. | Visual Observations for Evidence of Corrosion | |
| Additive | (v/v ppm) | 1 day | 2 days |
| No Add. | — | 5 | 5 |
| Composition M | 3.0 | 0 clean | 0 clean |

The compositions of this invention may be employed in any amount capable of inhibiting rust or corrosion, in minor amounts of at least 1 p.p.m., such as 5 p.p.m., for example 15 to 200 p.p.m., or more, but preferably 25–50 p.p.m.

In certain instances, it may be desirable to add larger amounts of the compositions of the invention, for example from about 20 to 1,000 p.p.m. or greater, such as 10,000 or greater, but there is generally no economic advantage in adding more than is required.

In addition, it is clearly understood that the claims of this invention include the presence of water therein as a dissolved, suspended, and/or separate phase. The compositions of this invention inhibit corrosion in those systems where water is in the dissolved, suspended, or separate phase, including inhibition in the gasohol phase, as well as the separate water phase or separate water-alcohol phase.

We claim:

1. A corrosion inhibited fuel composition consisting essentially of

I. an oxygenated fuel selected from the group consisting of ethanol, methanol, tertiary butyl alcohol, methyl tertiary butyl either and mixtures thereof, and II. a minor amount, effective to inhibit corrosion in the presence of water, of a solution of an alkenyl or alkyl succinic acid polymer or anhydride thereof in an aromatic hydrocarbon solvent, where the polymer has the repetitive unit

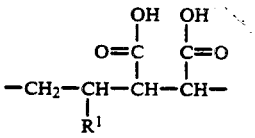

where $R^1$ has at least 8 carbons.

2. The composition of claim 1 wherein $R^2$ has 12 to 42 carbons.

3. The composition of claim 1 wherein $R^1$ has 20–28 carbons.

4. The composition of claim 1 where the polymer has the following formula

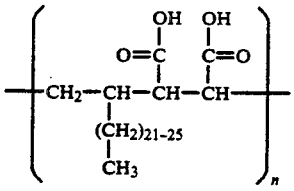

or the anhydride thereof n = 2–10

5. A corrosion inhibited fuel composition consisting essentially of

I. at least 5% of an oxygenated fuel selected from the group consisting of ethanol, methanol, tertiary butyl alcohol, methyl tertiary butyl ether and mixtures thereof, and II. a minor amount, effective to inhibit corrosion in the presence of water, of a solution of an alkenyl or alkyl succinic acid polymer or anhydride thereof in an aromatic hydrocarbon solvent, where the polymer has the repetitive unit

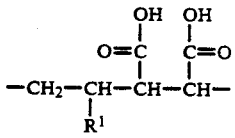

where $R^1$ has at least 8 carbons, and

III. gasoline.

6. The composition of claim 5 wherein $R^1$ has 12 to 42 carbons.

7. The composition of claim 5 wherein $R^1$ has 20–28 carbons.

8. The composition of claim 5 where the polymer has the following formula

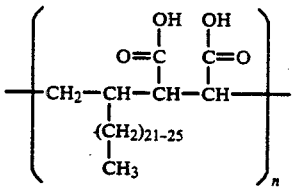

or the anhydride thereof.

n = 2–10

* * * * *